US005353991A

United States Patent [19]

De Nagel et al.

[11] Patent Number: 5,353,991

[45] Date of Patent: Oct. 11, 1994

[54] SOLENOID ACTUATED VALVE ASSEMBLY

[75] Inventors: Stephen F. De Nagel, Warren; Edward D. Klomp, Mt. Clemens; Andrzej M. Pawlak, Troy, all of Mich.

[73] Assignee: General Motors Corporation, Detroit, Mich.

[21] Appl. No.: 841,909

[22] Filed: Feb. 26, 1992

Related U.S. Application Data

[63] Continuation of Ser. No. 549,188, Jul. 6, 1990, abandoned, which is a continuation-in-part of Ser. No. 369,509, Jun. 21, 1989, abandoned.

[51] Int. Cl.[5] ..... F02M 69/08; F02M 51/08

[52] U.S. Cl. ..... 239/409; 239/585.2; 239/585.3; 137/870

[58] Field of Search ..... 239/407, 585.1, 585.3, 239/408, 409, 585.2; 137/596.17, 605, 870

[56] References Cited

U.S. PATENT DOCUMENTS 4,020,803 5/1977 Thuren et al. .
4,190,618 2/1980 Scheffer .
4,387,696 6/1983 Yogo et al. .
4,506,701 3/1985 Masaki et al. .
4,613,081 9/1986 Bauer .
4,655,255 4/1987 Rode .
4,693,420 9/1987 Klomp .
4,753,213 6/1988 Schlunke et al. .
4,759,335 7/1988 Ragg et al. .
4,771,754 9/1988 Reinke .
4,776,516 10/1988 Klomp .

FOREIGN PATENT DOCUMENTS 2397571 7/1972 Australia .
8500854 2/1985 PCT Int'l Appl. .
8807628 10/1988 PCT Int'l Appl. .

OTHER PUBLICATIONS

Lefebvre, "Airblast Atomization", Progress in Energy Combustion Science, vol. 6, pp. 233–261, 1980.
Obert, *Internal Combustion Engines Analysis and Practice*, pp. 370–371, 1950.
SAE Paper 880176, 1988.
SAE Paper 820351, 1982.

*Primary Examiner*—William Grant
*Attorney, Agent, or Firm*—Charles K. Veenstra

[57] ABSTRACT

A solenoid actuated valve assembly has first and second valve members, first and second valve seats, a solenoid coil, a first armature effective when the coil is energized with a positive current to permit displacement of the first valve member from the first valve seat, and a second armature effective when the coil is energized with a negative current to displace the second valve member from the second valve seat. The first valve member engages the first valve seat when the coil is energized with a negative current, and the second valve member engages the second valve seat when the coil is energized with a positive current.

1 Claim, 7 Drawing Sheets

SOLENOID ACTUATED VALVE ASSEMBLY

RELATED APPLICATION

This is a continuation of patent application Ser. No. 07/549,188 filed Jul. 6, 1990, now abandoned which is a continuation-in-part of patent application Ser. No. 07/369,509 filed Jun. 21, 1989, now abandoned.

TECHNICAL FIELD

This invention relates to a solenoid actuated valve assembly suitable for use as an injector adapted to deliver a charge of fuel and air directly into an engine combustion chamber.

BACKGROUND

U.S. Pat. No. 4,759,335, issued Jul. 26, 1988 in the names of P.W. Ragg, M.L. McKay and R.S. Brooks, shows an injector that delivers a fuel-air charge directly into the combustion chamber of a two-stroke cycle engine. The injector has a valve that meters fuel into the injector where the fuel mixes with air to form a fuel-air charge, and another valve that delivers the fuel-air charge into the engine. Separate solenoids actuate the valves in sequence.

SUMMARY OF THE INVENTION

This invention provides a valve assembly in which a single solenoid coil sequentially actuates both a fuel metering valve and a charge delivery valve.

In a solenoid actuated valve assembly according to this invention, a single solenoid coil has armatures that control two valves. One of the armatures opens one of the valves when the solenoid is energized with a positive current, and the other armature opens the other valve when the solenoid is energized with a negative current.

The details as well as other features and advantages of two injectors employing this invention are set forth in the remainder of the specification and are shown in the accompanying drawings.

DETAILED DESCRIPTION

Figure 1:
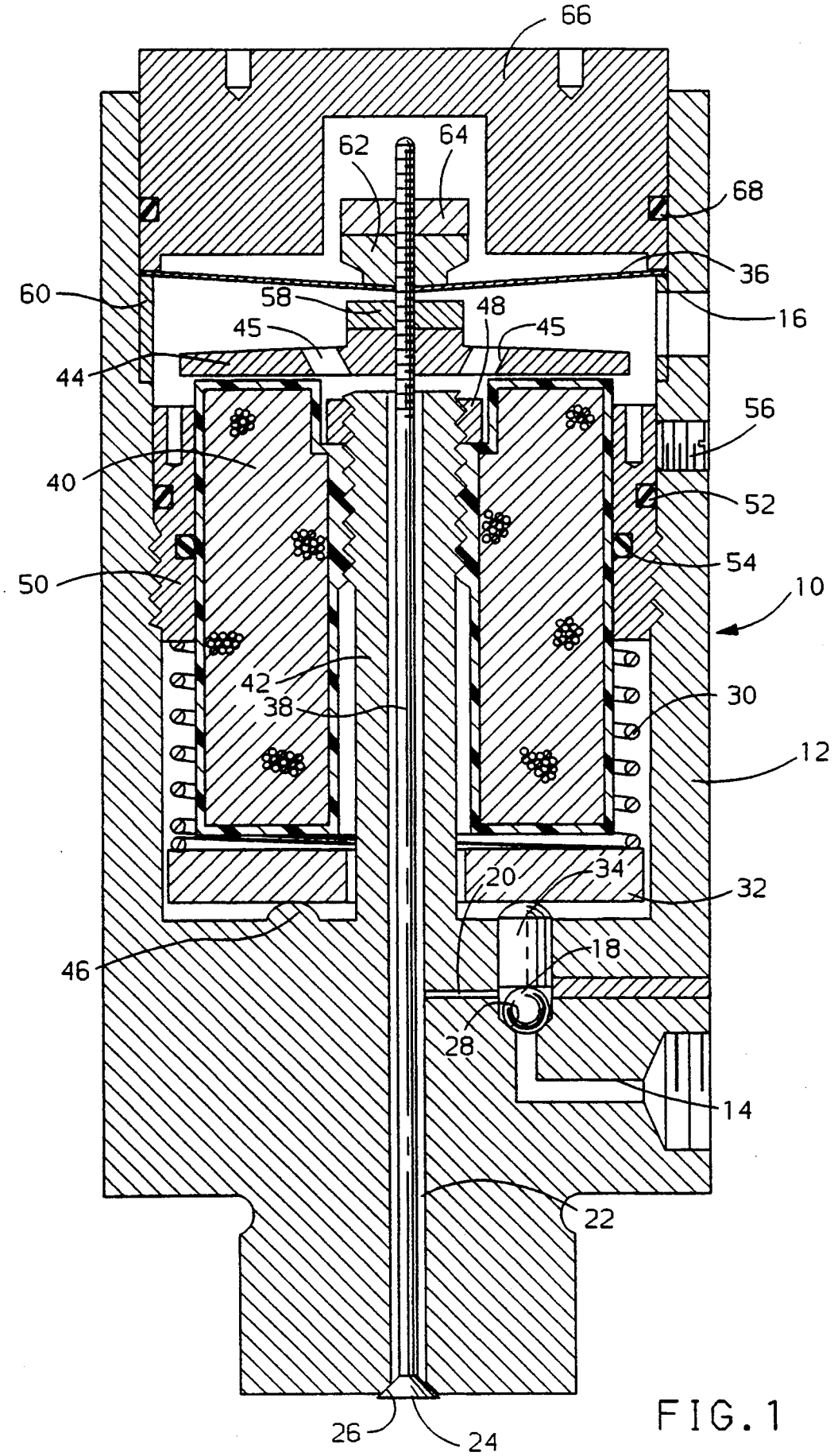
FIG. 1 is a schematic axial sectional view of one injector employing this invention.
Figure 2:
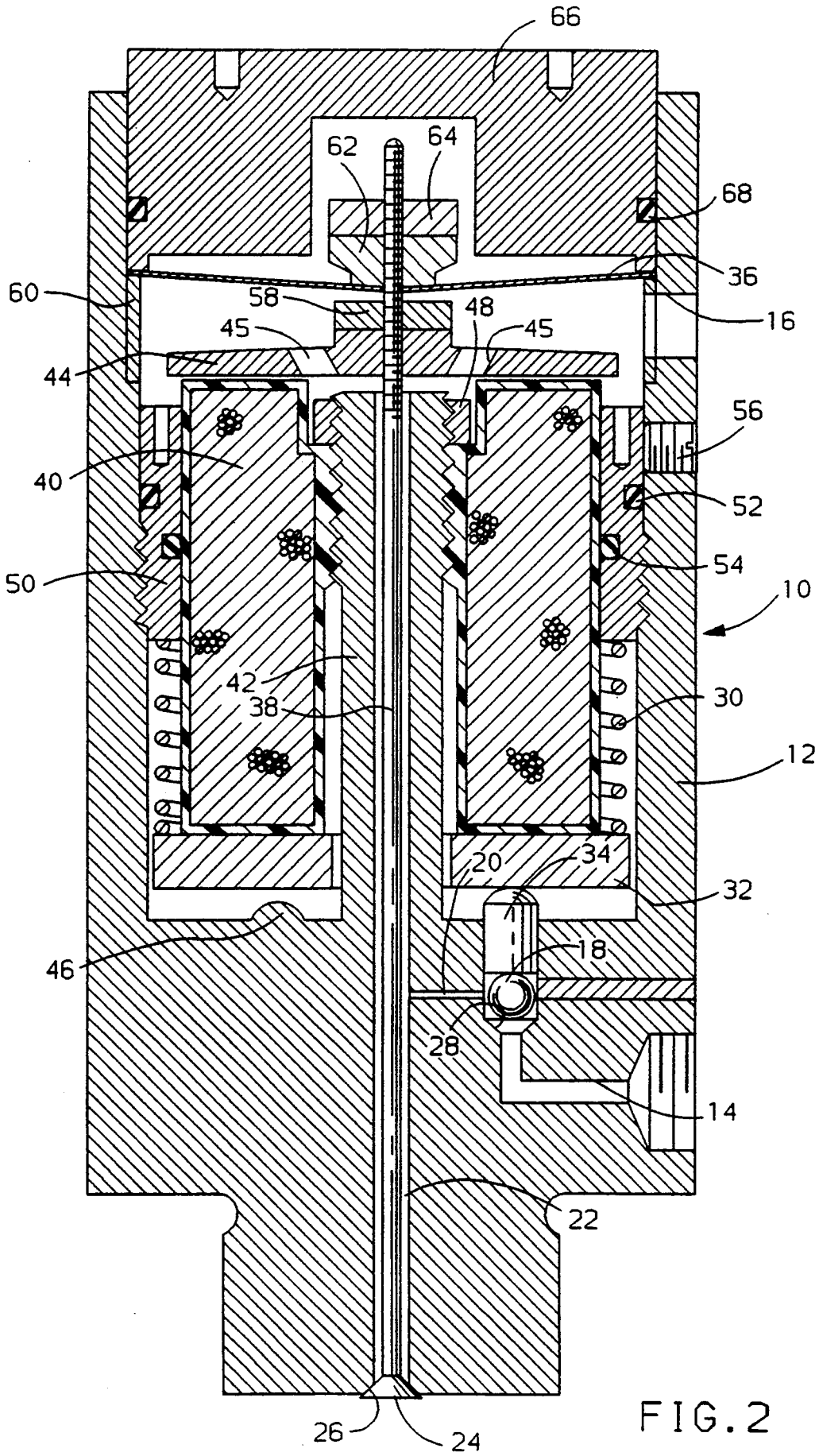
FIG. 2 is a view of the FIG. 1 injector showing the position of the parts during fuel metering.
Figure 3:
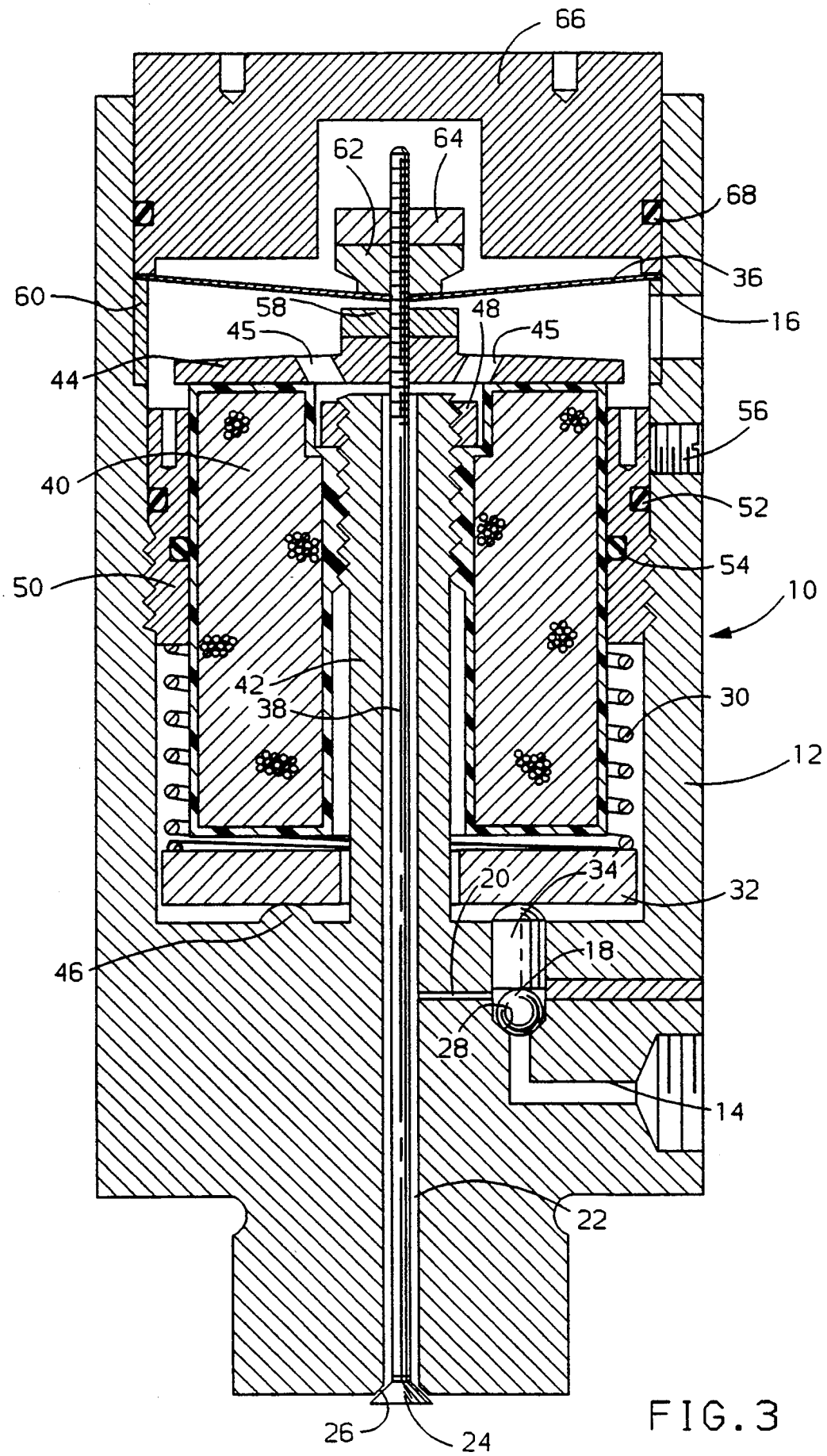
FIG. 3 is a view of the FIG. 1 injector showing the position of the parts during delivery of the fuel-air charge.

Referring first to FIGS. 1–3, an injector 10 has a body 12 that receives fuel through an inlet 14 and air through an inlet 16. A ball-type fuel metering valve 18 controls inlet 14; when ball valve 18 is opened, fuel is metered through an orifice 20 to a central passage 22 extending axially through body 12. A poppet-type charge delivery valve 24 engages a valve seat 26 surrounding the lower end of passage 22; when opened, valve 24 delivers a charge of fuel and air directly into an engine combustion chamber.

Ball valve 18 is biased against a seat 28 in inlet 14 by a coil spring 30 acting through a disc 32 and a pushrod 34. Poppet valve 24 is biased against seat 26 by a diaphragm-type spring 36 acting on the stem 38 of poppet valve 24.

Disc 32 is a permanent magnet armature of a solenoid assembly 39 having a coil 40 threaded onto a center post 42 in body 12. When coil 40 is energized with a positive current as shown in FIG. 2, coil 40 attracts disc armature 32 against the bias of spring 30, the fuel pressure in inlet 14 lifts ball valve 18 and pushrod 34, and fuel flows around ball 18 and is metered through orifice 20 to central passage 22. When the desired amount of fuel has been metered into passage 22, coil 40 is de-energized, and spring 30 re-engages fuel metering valve 18 with its seat 28.

Another permanent magnet armature 44 is secured on valve stem 38. Armature 44 has apertures 45 that allow air flow from inlet 16 to passage 22. When coil 40 is energized with a negative current as shown in FIG. 3, coil 40 attracts armature against the bias of spring 36, poppet valve 24 is displaced from seat 26, and the fuel-air charge in passage 22 is delivered into the engine. When the charge has been delivered into the engine, coil 40 is de-energized, and spring 36 re-engages charge delivery valve 24 with its seat 26.

When coil 40 is energized with a positive current to attract armature 32 and meter fuel into passage 22, armature 44 is repelled and adds to the valve closing force of spring 36 to maintain charge delivery valve 24 engaged with seat 26. When coil 40 is energized with a negative current to attract armature 44 and deliver the fuel-air charge from passage 22, armature 32 is repelled and adds to the valve closing force of spring 30 to maintain fuel metering valve 18 engaged with seat 28.

When armature 32 is in the position shown in FIGS. 1 and 3, it engages stops 46 which maintain it in proper alignment in body 12.

Injector 10 is assembled by placing ball valve 18 and pushrod 34 in body 12, placing armature 32 and spring 30 in body 12, and threading coil 40 on post 42. Coil 40 is bottomed out against armature 32, then backed out the proper amount to set the desired air gap between armature 32 and coil 40. A lock nut 48 is threaded onto post 42 to hold coil 40 in the desired position. An adjustment ring 50 is threaded into body 12 and positioned to set the desired force of spring 30; 0-rings 52 and 54 seal ring 50 to body 12 and coil 40, and a set screw 56 holds ring 50 in the desired position. Poppet valve 24 is inserted into body 12, and armature 44 is threaded onto valve stem 38. Armature 44 is bottomed out against coil 40, then backed out the proper amount to set the desired air gap between armature 44 and coil 40. A lock nut 58 is threaded onto stem 38 to hold armature 44 in the desired position. A clamp ring 60 is inserted into body 12, and spring 36 is fitted into body 12 and over stem 38. An adjustment nut 62 is threaded onto stem 38 and positioned to set the desired force of spring 36; a lock nut 64 is threaded onto stem 38 to hold adjustment nut 62 in the desired position. A cap 66 is threaded into body 12 to secure spring 36 and close the top of body 12; an O-ring 68 seals cap 66 to body 12.

Figure 4:
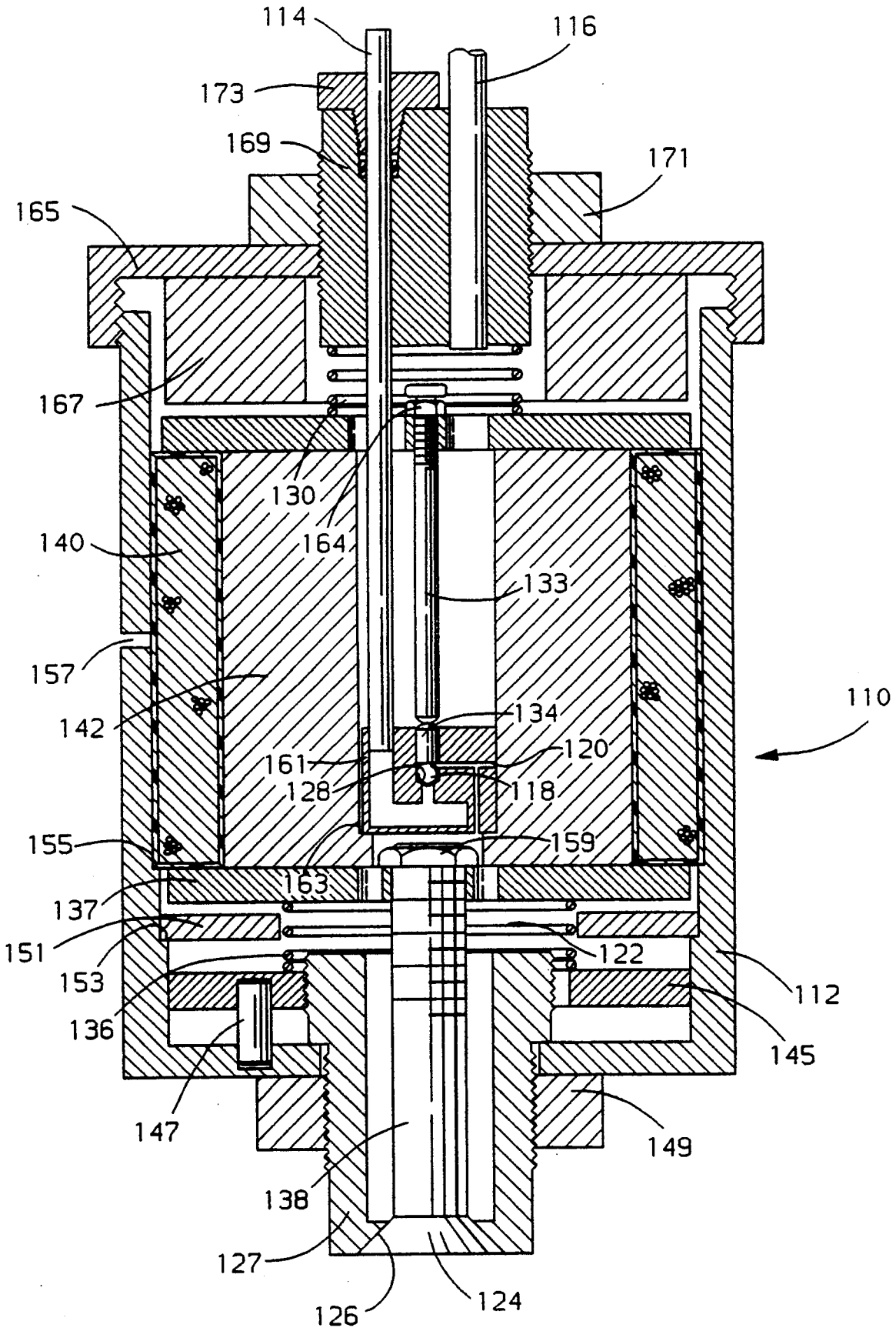
FIG. 4 is a schematic axial sectional view of another injector employing this invention.
Figure 5:
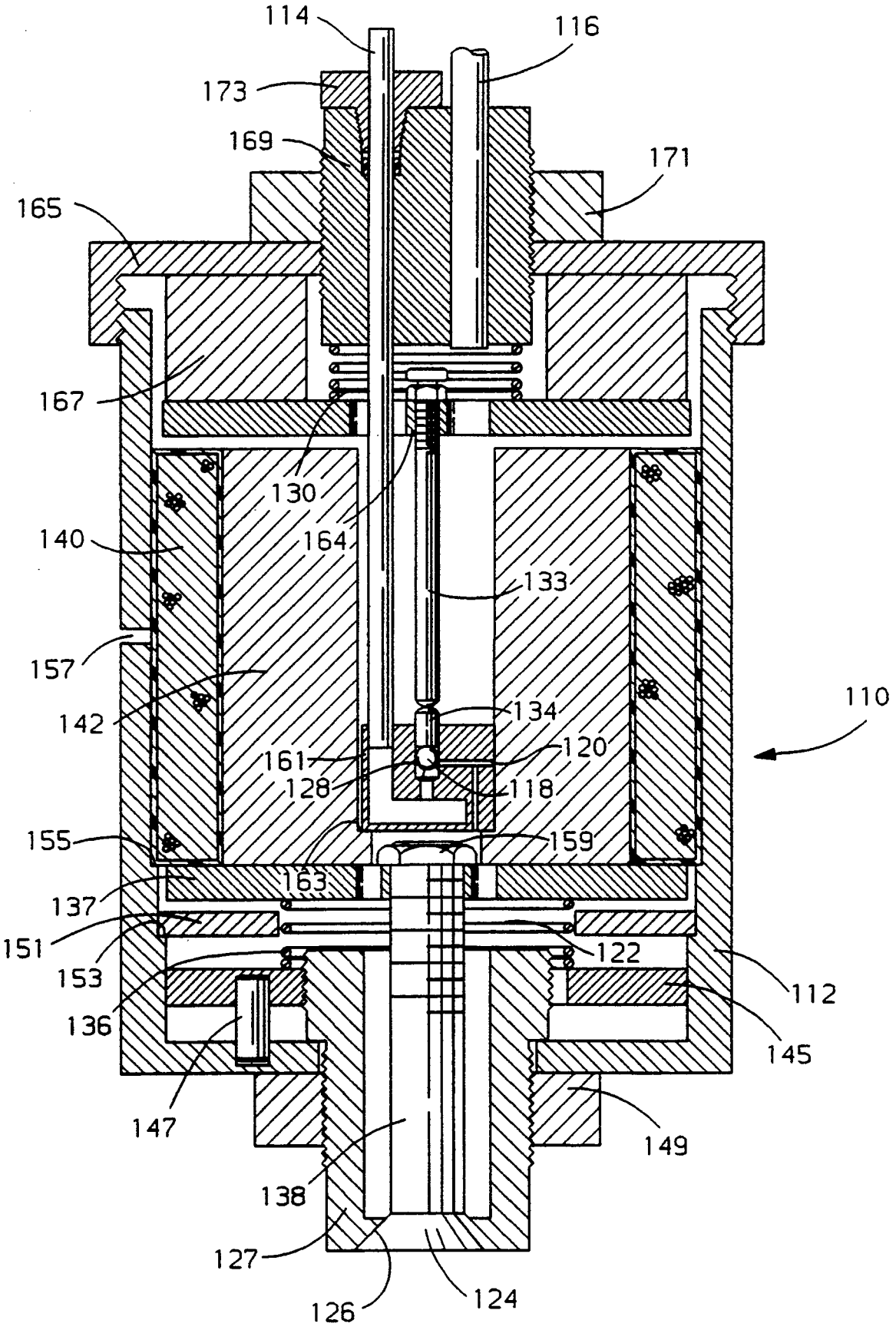
FIG. 5 is a view of the FIG. 4 injector showing the position of the parts during fuel metering.
Figure 6:
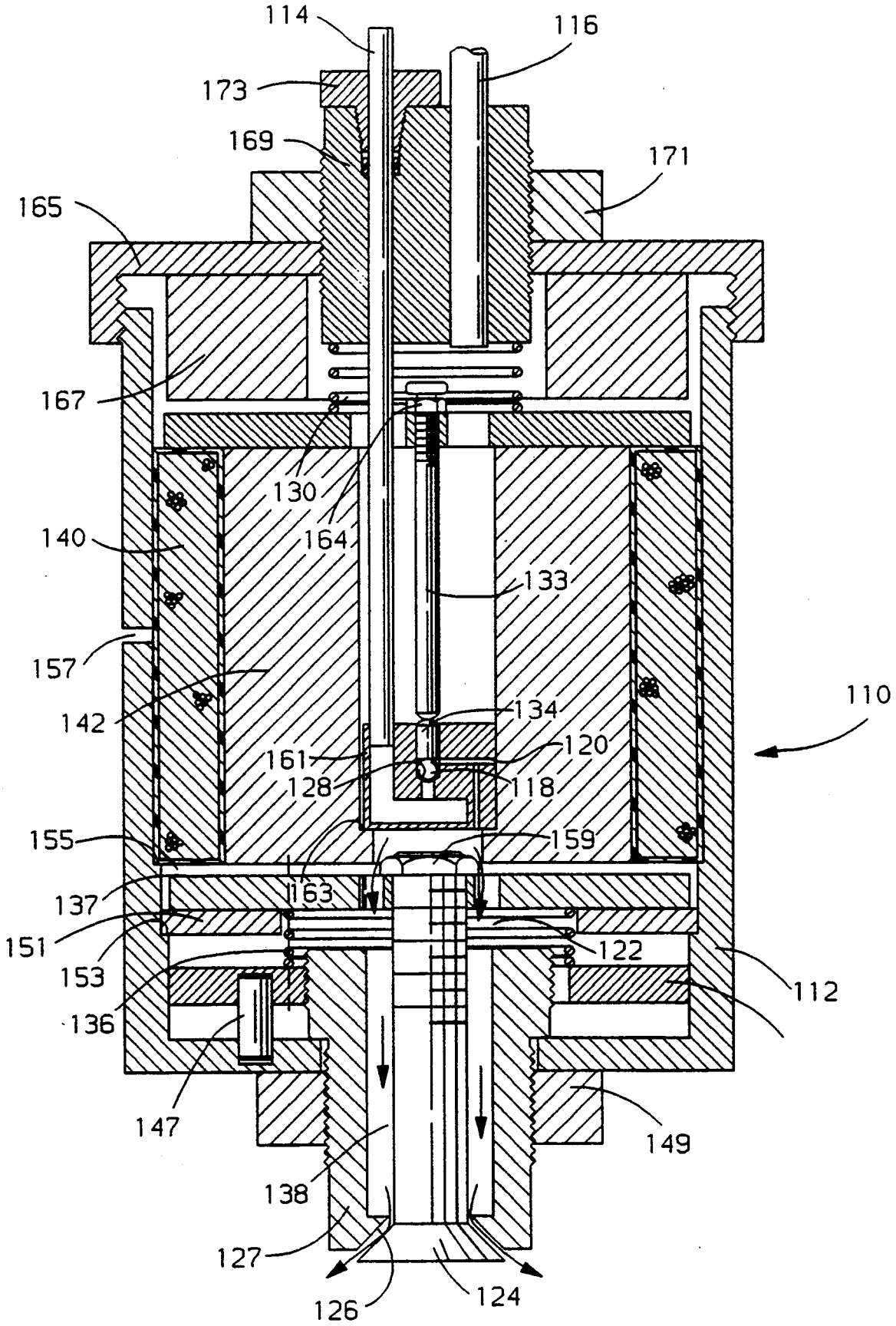
FIG. 6 is a view of the FIG. 4 injector showing the position of the parts during delivery of the fuel-air charge.

Referring next to FIGS. 4–6, an injector 110 has a multi-piece housing 112 that receives fuel through a fuel supply tube 114 and air through an air supply tube 116. A ball-type fuel metering valve 118 controls fuel flow from tube 114; when ball valve 118 is opened, fuel is metered through an orifice 120 to a cavity 122. A poppet-type charge delivery valve 124 engages a valve seat 126 in a nozzle 127 opening from the lower end of cavity 122; when opened, valve 124 delivers a charge of fuel and air directly into the engine.

Ball valve 118 is biased against a seat 128 by a coil spring 130 acting through a disc 132, a pushrod 133 threaded into disc 132, and a pin 134. Popper valve 124 is biased against seat 126 by a coil spring 136 acting through a disc 137 threaded onto the stem 138 of poppet valve 124.

Discs 132 and 137 are permanent magnet armatures of a solenoid assembly 139 having a coil 140 wound on a magnetic core 142. When coil 140 is de-energized as shown in FIG. 4, armature 132 is attracted toward the top of core 142, engaging ball valve 118 with its seat 128, while armature 137 is attracted toward the bottom of core 142, engaging poppet valve 124 with its seat 126.

When coil 140 is energized with a positive current as shown in FIG. 5, coil 140 repels armature 132 against the combined bias of spring 130 and magnetic attraction between armature 132 and core 142, the fuel pressure in inlet 114 lifts ball valve 118 and pin 134, and fuel flows around ball 118 and is metered through orifice 120 to cavity 122. When the desired amount of fuel has been metered into cavity 122, coil 140 is de-energized, and the combined bias of spring 130 and magnetic attraction between armature 132 and core 142 re-engages fuel metering valve 118 with its seat 128.

When coil 140 is energized with a negative current as shown in FIG. 6, coil 140 repels armature 137 against the combined bias of spring 136 and magnetic attraction between armature 137 and core 142, poppet valve 124 is displaced from seat 126, and the fuel-air charge in cavity 122 is delivered into the engine. When the charge has been delivered into the engine, coil 140 is de-energized, and the bias of spring 136 and magnetic attraction between armature 137 and core 142 re-engages charge delivery valve 124 with its seat 126.

When coil 140 is energized with a positive current to repel armature 132 and meter fuel into cavity 122, armature 137 remains attracted to core 142 and adds to the valve closing force of spring 136 to maintain charge delivery valve 124 engaged with seat 126. When coil 140 is energized with a negative current to repel armature 137 and deliver the fuel-air charge from cavity 122, armature 132 remains attracted to core 142 and adds to the valve closing force of spring 130 to maintain fuel metering valve 118 engaged with seat 128.

Injector 110 is assembled by inserting nozzle 127 in housing 112, an adjusting plate 145 being threaded on the upper end of nozzle 127 and fitting over an anti-rotation pin 147 carried by housing 112. A lock nut 149 is threaded onto nozzle 127 to hold it in place. A stop 151 is inserted against a shoulder 153 in housing 112, spring 136 is installed, and poppet valve 124 is inserted. Armature 137 is threaded onto valve stem 138 until the top of armature 137 is aligned with a shoulder 155 in housing, and coil 140 is inserted against shoulder 155 and secured with a set screw 157. The clearance between coil 140 and armature 137 is adjusted as desired by rotating valve 124 while holding armature 137 against rotation, and a lock nut 159 is threaded onto valve stem 138. Nozzle 127 is rotated within housing 112 and plate 145 to adjust the force exerted by spring 136, and lock nut 149 is tightened. A plenum member 161, including ball valve 118, pin 134 and fuel supply tube 114, is inserted against a shoulder 163 in core 142. Armature 132 is inserted against the top of coil 140, push rod 133 is adjusted to engage ball valve 118 against its seat 128, and a lock nut 164 is threaded on the top of push rod 133 to maintain the desired adjustment of push rod 133. Spring 130 is inserted, and a lid 165 is threaded onto housing 112. An upper stop 167 depends from the inside of lid 165, and lid 165 is threaded onto housing until stop 167 engages armature 132, then backed out to established the desired distance between armature 132 and stop 167. A lock screw secures lid 165 to housing 112. Lid 165 also carries a screw 169 that is adjusted to establish the desired force exerted by spring 130, and a lock nut 171 is threaded about screw 169. A split lock nut 173 is tightened about fuel supply tube 114 to assure that plenum member 161 remains against shoulder 163.

Figure 7:
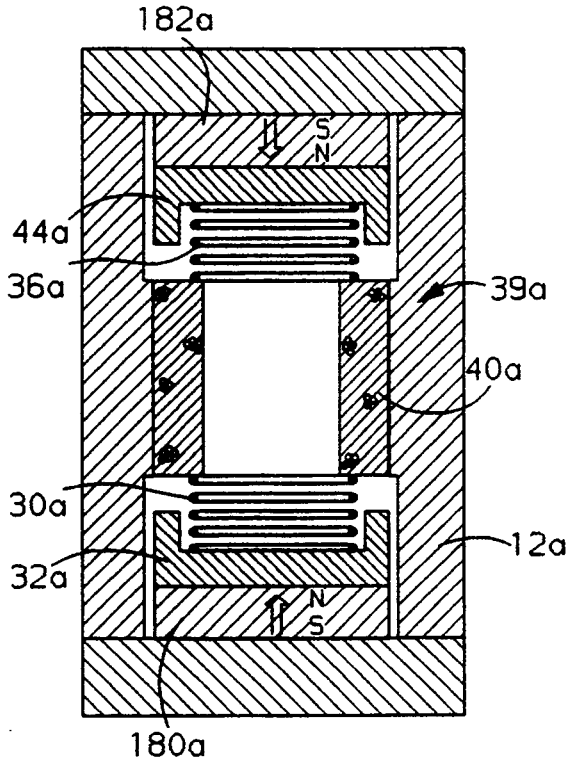
FIG. 7 is a schematic view of an alternate solenoid assembly for the injector of FIGS. 1–3.

FIG. 7 schematically illustrates an alternate solenoid assembly **39*a* for the injector of FIGS. 1–3. Disposed within a body 12*a*, solenoid assembly 39*a* has a coil 40*a* and a pair of magnetically responsive armature discs 32*a* and 44*a*. Springs 30*a* and 36*a* bias discs 32*a* and 44*a* to the positions shown. A permanent magnet 180*a* attracts disc 32*a* to the position shown, supplementing the bias of spring 30*a*, and a permanent magnet 182*a* attracts disc 44*a* to the position shown, supplementing the bias of spring 36*a*. When coil 40*a* is energized with a positive current, it attracts disc 32*a* against the bias of spring 30*a* and magnet 180*a*, while disc 44*a* remains in the position shown. When coil 40*a* is energized with a negative current, it attracts disc 44*a* against the bias of spring 36*a* and magnet 182*a*, while disc 32*a* remains in the position shown. It will be appreciated that springs 30*a* and 36*a*** may not be necessary for some embodiments.

Figure 8:
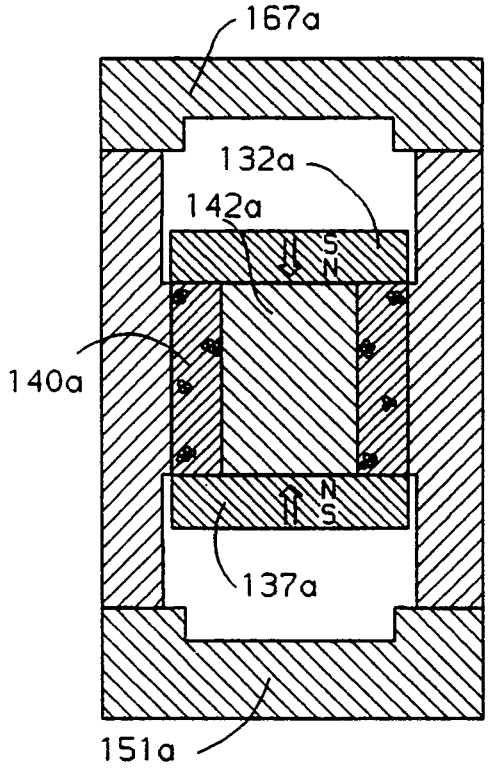
FIGS. 8 and 9 are schematic views of alternate solenoid assemblies for the injector of FIGS. 4–6.

FIG. 8 schematically illustrates an alternate solenoid assembly **139*a* for the injector of FIGS. 4–6. Disposed within a body 112*a*, solenoid assembly 139*a* has a coil 140*a* wound on a magnetic core 142*a*, and a pair of permanent magnet armature discs 132*a* and 137*a*. When coil 140*a* is energized with a positive current, it repels disc 132*a* toward a stop 167*a* against the bias of the magnetic attraction between disc 132*a* and core 142*a*, while disc 137*a* remains in the position shown. When coil 140*a* is energized with a negative current, it repels disc 137*a* toward a stop 151*a* against the bias of the magnetic attraction between disc 137*a* and core 142*a*, while disc 132*a* remains in the position shown. In this embodiment, the magnetic attraction of discs 132*a* and 137*a* to core 142*a*** biases them to the positions shown, and springs may not be necessary.

Figure 9:
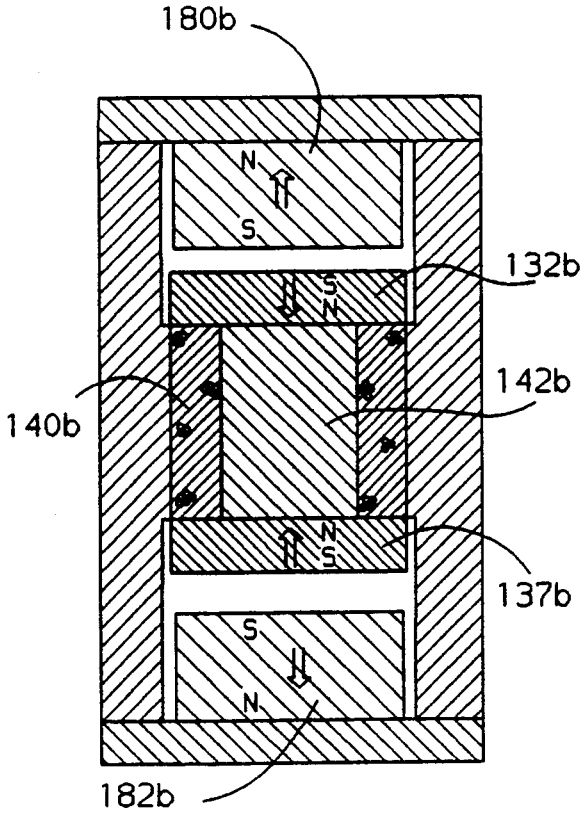

FIG. 9 schematically illustrates another alternate solenoid assembly **139*b* for the injector of FIGS. 4–6. Disposed within a body 112*b*, solenoid assembly 139*b* has a coil 140*b* wound on a magnetic core 142*b*, and a pair of permanent magnet armature discs 132*b* and 137*b*. A permanent magnet 180*b* magnetically repels disc 132*b* to the position shown, supplementing the magnetic attraction between disc 132*b* and core 142*b*, and a permanent magnet 182*b* magnetically repels disc 137*b* to the position shown, supplementing the magnetic attraction between disc 137*b* and core 142*b*. When coil 140*b* is energized with a positive current, it repels disc 132*b* against the bias of the magnetic attraction between disc 132*b* and core 142*b*, and against the bias of the magnetic repulsion between disc 132*b* and magnet 180*b*, while disc 137***b* remains in the position shown. When coil 140*b* is energized with a negative current, it repels disc 137*b* against the bias of the magnetic attraction between disc 137*b* and core 142*b*, and against the bias of the magnetic repulsion between disc 137*b* and magnet 182*b*, while disc 132*b* remains in the position shown. In this embodiment, the magnetic attraction of discs 132*b* and 137*b* to core 142*b* and the magnetic repulsion of discs 132*b* and 137*b* from magnets 180*b* and 182*b* biases them to the positions shown, and springs are not necessary.

We claim:

1. An injector for delivering a charge of fuel and air directly into an engine combustion chamber, the injector having an air inlet, a fuel inlet, a valve seat associated with the fuel inlet, a fuel metering valve member, a spring biasing the fuel metering valve member to engage the fuel inlet valve seat, a valve seat through which a charge of fuel and air is delivered to the engine, a charge delivery valve member, a spring biasing the charge delivery valve member to engage the charge delivery valve seat, a solenoid coil, a permanent magnet fuel metering armature disposed at one end of the coil and attracted toward the coil when the coil is energized with a positive current to permit displacement of the fuel metering valve member from the fuel inlet valve seat to meter fuel into the injector, the fuel metering armature further being repelled from the coil when the coil is energized with a negative current to maintain the fuel metering valve member in engagement with the fuel inlet valve seat, and a permanent magnet charge delivery armature disposed at the other end of the coil and attracted toward the coil when the coil is energized with a negative current to displace the charge delivery valve member from the charge delivery valve seat to deliver a charge of fuel and air to the engine, the charge delivery armature further being repelled from the coil when the coil is energized with a positive current to maintain the charge delivery valve member in engagement with the charge delivery valve seat.

* * * * *